US006394194B1

(12) United States Patent
Queen et al.

(10) Patent No.: US 6,394,194 B1
(45) Date of Patent: May 28, 2002

(54) METHOD AND APPARATUS FOR A DRILL CUTTING INJECTION SYSTEM

(75) Inventors: Michael Queen, Aberdeen; James David Mathers Peter, Oldmeldrum; Norman Brammer, Fyvie; Alan Clark, Aberdeen, all of (GB)

(73) Assignee: ABB Vetco Gray Inc., Houston, TX (US)

( * ) Notice: Subject to any disclaimer, the term of this patent is extended or adjusted under 35 U.S.C. 154(b) by 0 days.

(21) Appl. No.: 09/553,904

(22) Filed: Apr. 20, 2000

Related U.S. Application Data

(60) Provisional application No. 60/131,043, filed on Apr. 26, 1999.

(51) Int. Cl.[7] ..... E21B 21/10; E21B 43/00

(52) U.S. Cl. ..... 175/66; 166/75.15; 166/368; 175/210; 175/218

(58) Field of Search ..... 166/75.15, 90.1, 166/368; 175/5, 66, 207, 209, 210, 215, 218

(56) References Cited

U.S. PATENT DOCUMENTS

| | | | | | |
|---|---|---|---|---|---|
| 4,683,963 | A | * | 8/1987 | Skinner | 175/66 |
| 4,942,929 | A | * | 7/1990 | Malachosky et al. | 175/66 |
| 5,085,277 | A | * | 2/1992 | Hopper | 166/341 |
| 5,129,469 | A | * | 7/1992 | Jackson | 175/66 |
| 5,303,786 | A | * | 4/1994 | Prestridge et al. | 175/66 |
| 5,339,912 | A | | 8/1994 | Hosie et al. | 175/66 |
| 5,431,236 | A | * | 7/1995 | Warren | 175/66 |
| 5,662,169 | A | | 9/1997 | Hosie | 166/344 |
| 5,884,715 | A | * | 3/1999 | Reddoch | 175/66 |
| 6,227,300 | B1 | * | 5/2001 | Cunningham et al. | 166/339 |

FOREIGN PATENT DOCUMENTS

| | | | | |
|---|---|---|---|---|
| GB | 2239471 A | | 3/1991 | E21B/41/00 |
| GB | 2327442 A | * | 1/1999 | E21B/21/06 |
| GB | 2327958 A | | 10/1999 | E21B/41/00 |

* cited by examiner

*Primary Examiner*—David Bagnell
*Assistant Examiner*—Jennifer H Gay
(74) *Attorney, Agent, or Firm*—Bracewell & Patterson, L.L.P.

(57) ABSTRACT

A drill cuttings injection system for a well with a wellhead housing and a casing hanger supported in the wellhead housing. The wellhead has an axial flow port with an upper end in communication with an outer surface of the housing and a lower end in communication with an inner surface of the housing. An injection ring is positioned on the wellhead housing and has an external port. The injection ring defines an annular gallery in communication with the upper end of the axial flow port. A cuttings injector is adapted to land on the injection ring and has a hydraulic passageway sealable to the external port through which drill cuttings can be pumped into the well.

18 Claims, 4 Drawing Sheets

METHOD AND APPARATUS FOR A DRILL CUTTING INJECTION SYSTEM

CROSS-REFERENCE TO RELATED APPLICATIONS

This application claims the benefits of provisional application Ser. No. 60/131,043 filed on Apr. 26, 1999, in the United States Patent and Trademark Office.

FIELD OF THE INVENTION

This invention relates in general to disposal of drill cuttings generated from drilling a subsea well, and more particularly to a system that allows the cuttings to be injected into a drilled well.

BACKGROUND OF THE INVENTION

When a subsea well is drilled, cuttings, which are small chips and pieces of various earth formations, will be circulated upward in the drilling mud to the drilling vessel. These cuttings are separated from the drilling mud and the drilling mud is pumped back into the well, maintaining continuous circulation while drilling. Ultimately, the cuttings must be disposed of.

In the past, these cuttings have been dumped directly into the sea. While such a practice is acceptable with water based drilling muds, oil based drilling cuttings would be contaminated with oil and would result in pollution if dumped into the sea. As a result, environmental regulations now prohibit dumping into the sea cuttings produced with oil based drilling mud.

There have been various proposals to dispose of oil based drilling cuttings. One proposal is to inject the cuttings back into the drilled well with a cuttings injection system. While systems exist in the prior art which allow injection of cuttings back into the drilled well, each has various drawbacks. The drawbacks include requiring detailed alignment of flow passageways, no provisions for twist that may occur while running the various casings, and requiring multiple runs to the well to set up the system. Therefore, there is a need for a simple cuttings injection system that can be run simultaneously with or after the wellhead housing and that compensates for twist in the wellhead requiring no detailed alignment of passageways.

SUMMARY OF THE INVENTION

The present invention is directed to an improved cuttings injection system for a well. The well has a wellhead housing and a casing hanger connected to a casing and sealed in the wellhead housing. The system has at least one flow port through a sidewall of the wellhead housing in communication with an annulus surrounding the casing. An injection ring on the wellhead housing has an external port and defines an internal annular gallery in communication with the flow port. A cuttings injector coupled to the injection ring that has a passageway sealable to the external port through which drill cuttings can be pumped for flowing through the gallery, flow port and into the annulus.

The lower end of the flow port is in communication with an inner surface of the housing below the packoff of the casing hanger and the upper end in communication with an outer surface of the housing above the packoff of the casing hanger. The at least one flow port comprises a plurality of flow ports. The injection ring is mounted to rotate relative to the wellhead housing. The well has guide posts and a first guide frame is joined to the injection ring adapted to engage the guide posts and position the injection ring. A second guide frame is joined to the cuttings injector adapted to engage the guide posts and position the passageway of the cuttings injector relative to the external port of the injection ring. The cuttings injector has an injection stab extendable into the external port to seal the passageway with the injection ring. The wellhead housing is supported by a low pressure wellhead housing and the injection ring is above the low pressure wellhead housing. The cuttings injector has a center ring that concentrically engages and supports the cuttings injector on the injection ring.

DETAILED DESCRIPTION OF THE INVENTION

Figure 1:
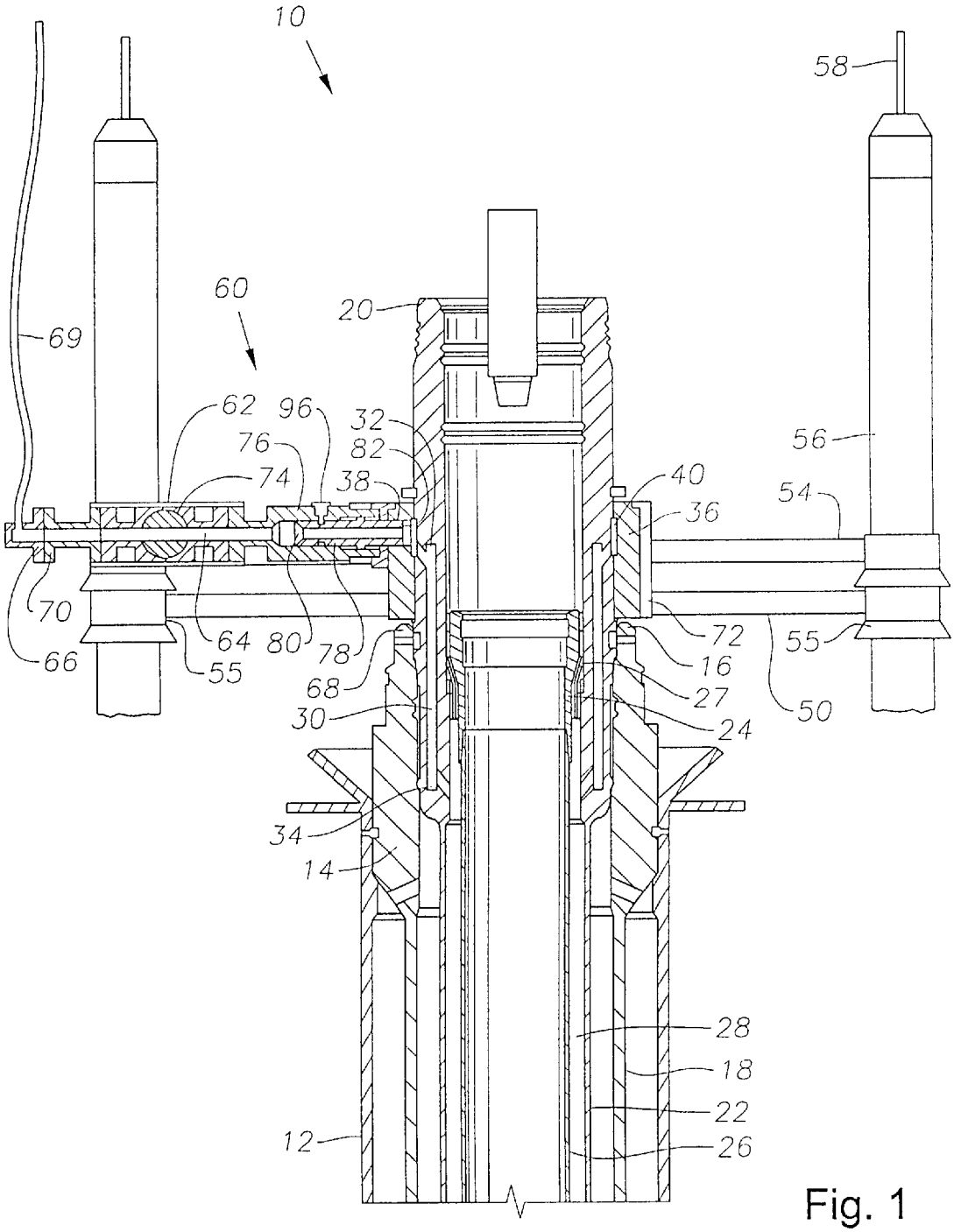
FIG. 1 is a cross-sectional view of the drill cuttings injection system of the invention with the drill cuttings injector assembly in position surrounding an injection ring mounted on the high pressure wellhead housing of a wellhead.

Referring now to FIG. 1, a drill cuttings injection system 10 is shown. A wellhead receptacle 12 is located on the sea floor. A low pressure wellhead housing 14 is landed within wellhead receptacle 12. Alternatively, the low pressure wellhead housing 14 may be run using a guide base assembly (not shown). The low pressure wellhead housing 14 has an upper rim 16. Casing 18, preferably 30" in diameter, extends downward from low pressure wellhead housing 14 within wellhead receptacle 12. A high pressure wellhead housing 20 is landed within the low pressure wellhead housing 14. High pressure wellhead housing 20 supports intermediate casing 22, which is preferably 20" in diameter, and extends downward from a lower end of high pressure wellhead housing 20. Intermediate casing 22 extends within casing 18. A casing hanger 24 is landed within high pressure wellhead housing 20 and sealed by a packoff casing hanger seal 27. Casing 26, preferably 13⅜" in diameter, is supported by and extends downward from a lower end of casing hanger 24. Casing 26 extends within intermediate casing 22. An annulus 28 is defined between casing 26 and intermediate casing 22.

A plurality of bypass passages 30 are formed within a wall of high pressure wellhead housing 20. Bypass passages 30 are shown in greater detail in FIG. 3. Bypass passages 30 are circumferentially spaced around high pressure wellhead housing 20. Each bypass passage 30 extends parallel to the axis of wellhead housing 20. Each bypass passage 30 has an upper end 32 having an upper auxiliary port 33 (FIG. 3) in communication with an exterior surface of high pressure wellhead housing 20. Upper end 32 extends above upper rim 16 of low pressure wellhead housing 14 and above packoff 27 of casing hanger 24. Bypass passages 30 have a lower end 34 having a lower auxiliary port 35 (FIG. 3) in communication with an inner surface of high pressure wellhead housing 20 and with annulus 28. Lower end 34 extends below packoff 27 of casing hanger 24.

An injection ring 36 surrounds high pressure wellhead housing 20. Injection ring 36 has an external port 38. Injection ring 36 and an annular recess on high pressure wellhead housing 20 define an annular gallery chamber 40 that circles high pressure wellhead housing 20 and communicates with each upper end 32 of the bypass passages 30.

Figure 3:
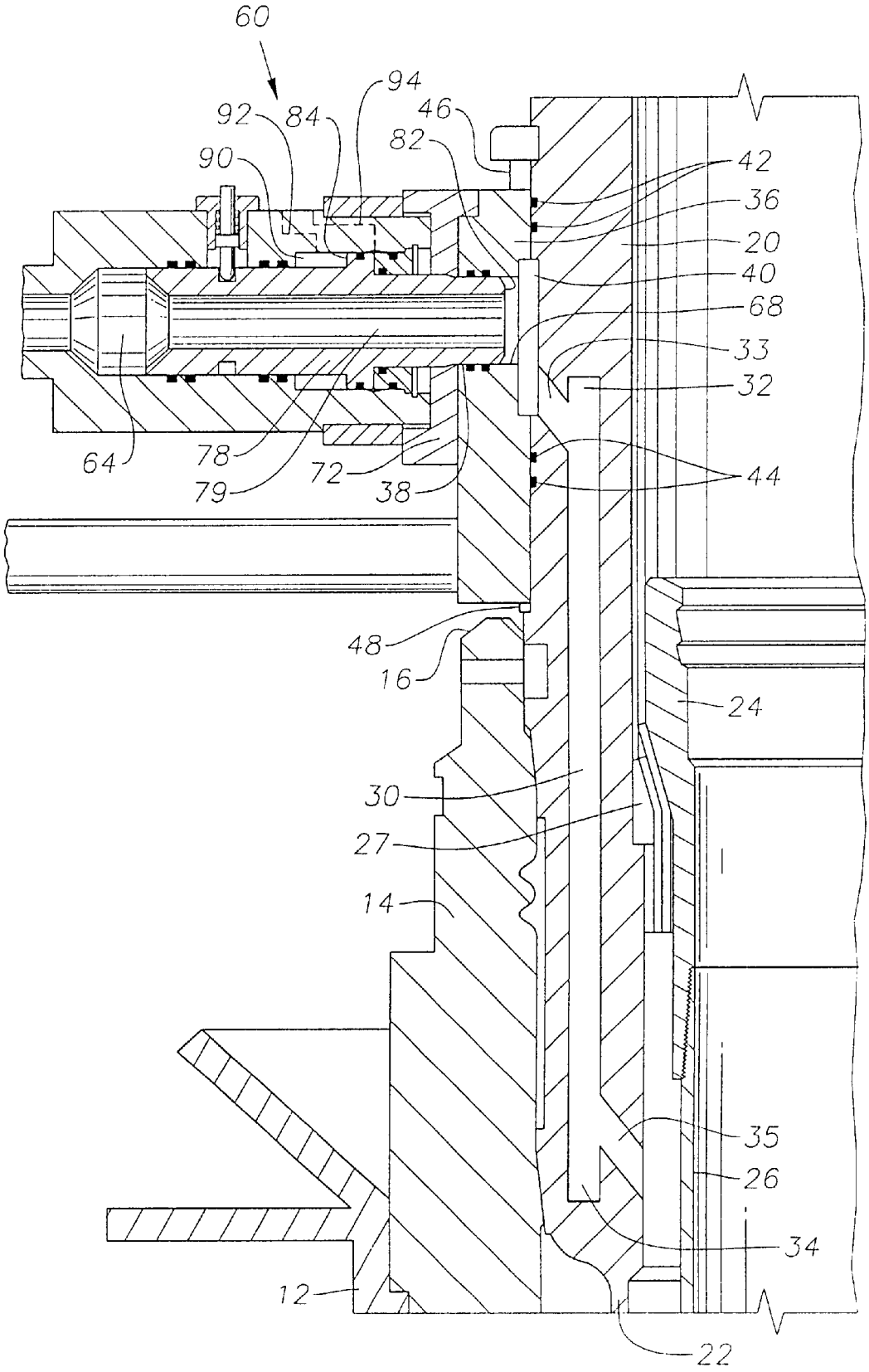
FIG. 3 is an enlarged cross-sectional view of the modified high pressure wellhead housing shown in FIGS. 1 and 2, showing the bypass passages 30.
Figure 4:
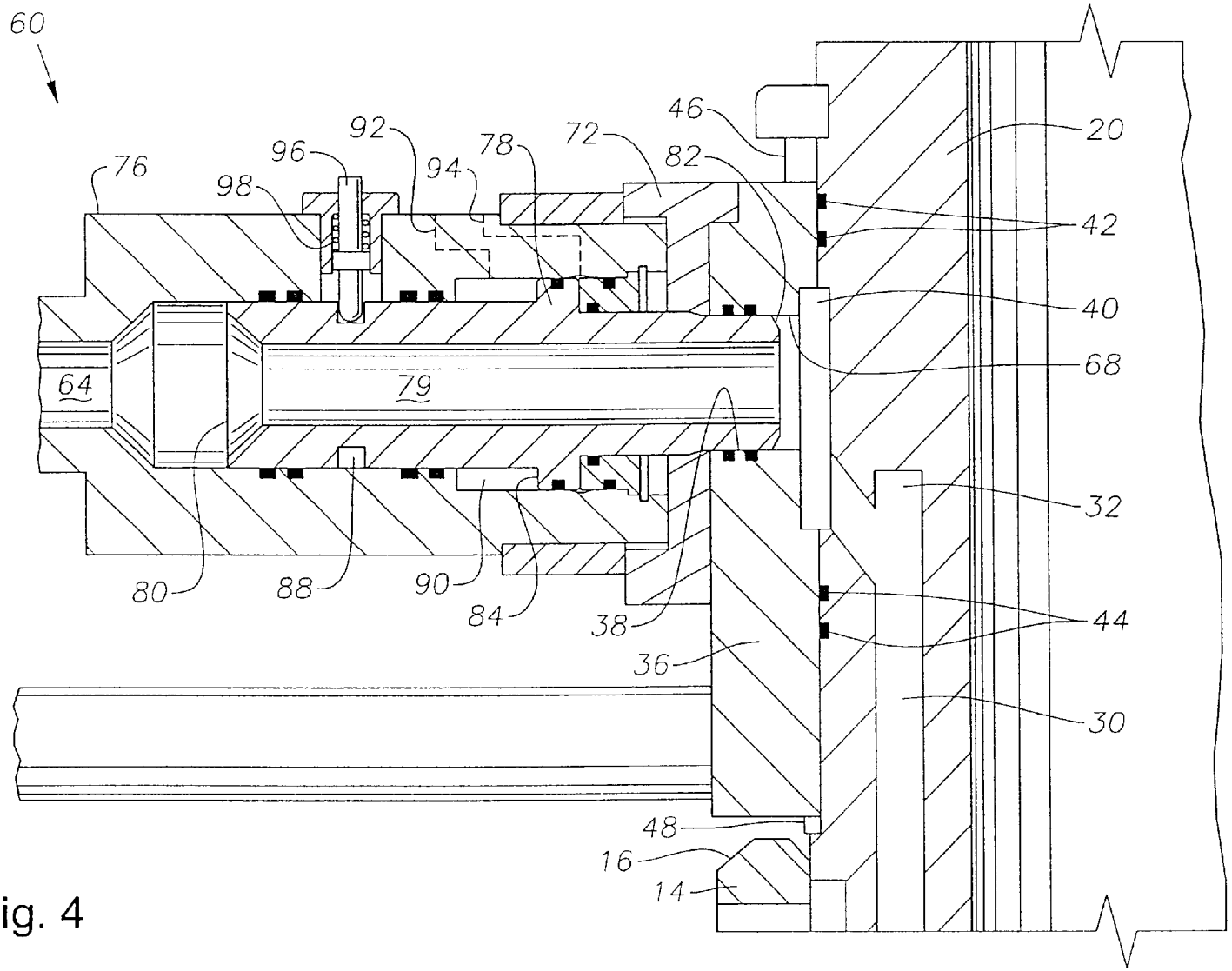
FIG. 4 is an enlarged view of the hydraulic injector stab in communication with the bypass passages in the high pressure wellhead housing of the invention shown in FIGS. 1 and 2.

Shown most clearly in FIGS. 3 and 4, a pair of upper gallery seals 42 are positioned between injection ring 36 and high pressure wellhead housing 20 at a location above annular gallery chamber 40. Similarly, a pair of lower gallery seals 44 are located between injection ring 36 and high pressure wellhead housing 20 below annular gallery chamber 40. An upper rotation bearing ring 46 is positioned above injection ring 36. A lower rotation bearing ring 48 is positioned below injection ring 36. Upper rotation bearing ring 46 and lower rotation bearing ring 48 facilitate rotation of injection ring 36 with respect to the high pressure wellhead housing 20.

Figure 2:
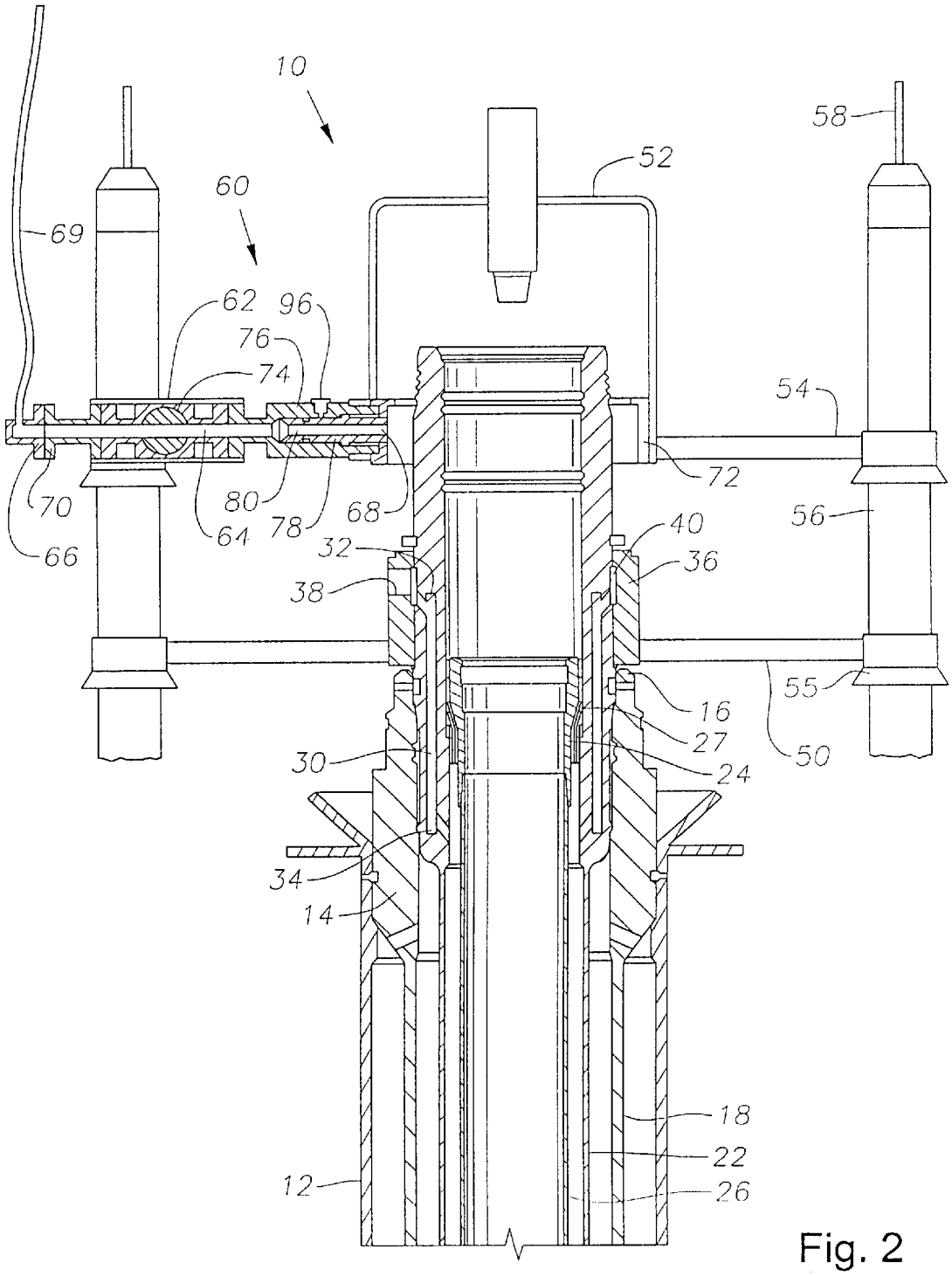
FIG. 2 is a cross-sectional view of the drill cuttings injection system of the invention with the drill cuttings injector assembly being lowered into position.

Referring now to FIGS. 1 and 2, subsea template or guide base (not shown) has a plurality of upwardly extending guide posts 56. Injection ring 36 has a guide frame 50 with guide cones 55 which provide guidance over guide wires 58 while running down to the well. Guide cones 55 then engage over guide posts 56 to position injection ring 36. Injection ring 36 can rotate relative to high pressure wellhead housing 20 when landing on guide posts 56.

A drill cuttings injector assembly 60, is affixed to a second guide frame 54 similar to guide frame 50 and lowered with a running tool 52 (FIG. 2). Guide frame 54 is positioned by guide posts 56 as above and lowered over injection ring 36. Drill cuttings injector assembly 60 has a body 62 that houses a portion of hydraulic passageway 64, which has an outer end 66 and an inner end 68. A flange 70 on first end 66 is provided for connection with an umbilical line 69 (FIGS. 1 and 2) that extends down from a drilling vessel (not shown). A center ring 72 is provided proximate second end 68 of hydraulic passageway 64. A ball valve 74 is positioned within body 62 for selectively closing hydraulic passageway 64. An outer cylinder 76 is affixed to body 64. Outer cylinder 76 houses a hydraulic injection stab 78, which has an outer end 80 and an inner end 82. Stab 78 is positioned to align with external port 38 on injection ring 36 when guide frames 50 and 54 are engaged with guide posts 56.

Referring now to FIGS. 3 and 4, a flange 84 surrounds hydraulic injection stab 78. Hydraulic injection stab 78 is slidably received within outer cylinder 76 and has a central passageway 79 that forms part of hydraulic passageway 64. An annular groove 88 is formed on an outside surface of hydraulic injection stab 78. An annular chamber 90 is defined by hydraulic injection stab 78 and outer cylinder 76. Flange 84 protrudes into annular chamber 90. A stab port 92 is provided for delivering hydraulic fluid into annular chamber 90 to force flange 84 and hydraulic injection stab 78 forward. Similarly, a return port 94 is provided for delivering hydraulic fluid into annular chamber 90 to force flange 84 and hydraulic injection stab 78 backward.

A hydraulic stab injection rod 96 is radially mounted in outer cylinder 76. Hydraulic stab injection rod 96 is biased inwardly by a spring 98 (FIG. 4). Hydraulic stab injection rod 96 reacts within outer cylinder 76 when the annular groove 88 is positioned below the hydraulic stab injection rod 96. Rod 96 locks stab 78 in the inward engaged position.

In operation, a wellhead receptacle 12 is located on the sea floor. A low pressure wellhead housing 14 and string of casing 18 is lowered into the receptacle 12. An operator then drills through casing 18 to a selected depth. A high pressure wellhead housing is lowered with casing 22 and cemented in place. Guide frame 50 engages guide posts 56 and aligns injection ring 36. A casing hanger 24 is lowered with casing 26, leaving an annulus 28 between casing 26 and casing 22. Cuttings from the drilling operation are slurrified. When it is desired to dispose of cuttings, an umbilical line 69 is affixed to flange 70 on first end 66 of hydraulic passageway 64 in the drill cuttings injector assembly 60. Drill cuttings injector assembly 60 is located on guide frame 54. The guide frame 54 may either be attached to and lowered with high pressure wellhead housing 20 or the guide frame 54 may be lowered separately at any time after running the high pressure wellhead housing 20. FIG. 2 shows the guide frame 54 being lowered on a running tool 52 after installation of high pressure wellhead housing 20. The center ring 72 of drill cuttings injector assembly 60 is positioned around injection ring 36 on high pressure wellhead housing 20 and the running tool 52 is removed as is shown in FIG. 1. Hydraulic injection stab 78 is oriented to insert into external port 38 of injection ring 36.

Hydraulic fluid is forced into stab port 92, which forces hydraulic injection stab 78 forward into communication with external port 38 of injection ring 36. Slurrified well cuttings may then be pumped down umbilical line 69 through the drill cuttings injector 60. The slurrified well cuttings pass through the external port 38 of an injection ring 36 and into the annular gallery chamber 40 and around the circumference of the high pressure wellhead housing 20. The slurrified well cuttings then flow down the circumferentially spaced bypass passages 30, which are formed in a wall of the high pressure wellhead housing 20. The pumped slurrified well cuttings then flow into the well annulus 28. When no more cuttings are desired to be pumped into the well, axial passage 30 is closed off by one of many methods known in the art, for example pumping drilling mud into the passage 30.

The invention has several advantages. The drill cuttings injector assembly may be easily engaged with the injection ring positioned on a high pressure wellhead housing. The drill cuttings injector assembly has the ability to be run with the high pressure wellhead housing or separately at any time after running the high pressure wellhead housing. The annular gallery chamber of the injection ring allows injected drilling cuttings to be evenly distributed between the plurality of circumferentially spaced bypass passages in the high pressure wellhead housing. Upper and lower bearing rings allow the injection ring to rotate about the high pressure wellhead housing. Rotation of the injector ring allows orientation of the hydraulic injection stab in the event of twisting occurring during running of the intermediate casing.

Although the invention has been shown in only one of its forms, it should be apparent to those skilled in the art that it is not so limited, but is susceptible to various changes without departing from the scope of the invention.

We claim:

1. In a system for injecting drill cuttings into a well, wherein the well has a wellhead housing and a casing hanger connected to a casing and sealed in the wellhead housing by a packoff, the system comprising:

at least one flow passage through a sidewall of the wellhead housing in communication with an annulus surrounding the casing;

an injection ring having an inner surface in contact with an exterior surface of the wellhead housing, the injection ring having an external port and defining an internal annular gallery in communication with the flow passage; and a cuttings injector coupled to the injection ring that has a passageway sealable to the external port through which the drill cuttings can be pumped for flowing through the gallery, flow passage, and into the annulus.

2. The system of claim 1 wherein a lower end of the flow passage is in communication with an inner surface of the housing below the packoff of the casing hanger and an upper end in communication with an outer surface of the housing above the packoff of the casing hanger.

3. The system of claim 1 where the at least one flow passage comprises a plurality of flow passages.

4. The system of claim 1 wherein the cuttings injector has an injection stab extendable into the external port to seal the passageway with the injection ring.

5. The system of claim 1 wherein the cuttings injector has a center ring having an inner surface that concentrically engages an outer surface of the injection ring and supports the cuttings injector on the injection ring.

6. In a system for injecting drill cuttings into a well, wherein the well has a wellhead housing and a casing hanger connected to a casing and sealed in the wellhead housing by a packoff, the system comprising:

at least one flow passage through a sidewall of the wellhead housing in communication with an annulus surrounding the casing;

an injection ring on the wellhead housing having an external port and defining an internal annular gallery in communication with the flow passage;

a cuttings injector coupled to the injection ring that has a passageway sealable to the external port through which the drill cuttings can be pumped for flowing through the gallery, flow passage, and into the annulus; and wherein the injection ring is mounted to rotate relative to the wellhead housing.

7. The system of claim 6 wherein the well has guide posts, the system further comprising:

a first guide frame joined to the injection ring adapted to engage the guide posts and angularly position the injection ring; and a second guide frame joined to the cuttings injector adapted to engage the guide posts and position the passageway of the cuttings injector relative to the external port of the injection ring.

8. In a system for injecting drill cuttings into a well, wherein the well has a wellhead housing and a casing hanger connected to a casing and sealed in the wellhead housing by a packoff, the system comprising:

at least one flow passage through a sidewall of the wellhead housing in communication with an annulus surrounding the casing;

an injection ring on the wellhead housing having an external port and defining an internal annular gallery in communication with the flow passage;

a cuttings injector coupled to the injection ring that has a passageway sealable to the external port through which the drill cuttings can be pumped for flowing through the gallery, flow passage, and into the annulus; and wherein the wellhead housing is supported by a low pressure wellhead housing and the injection ring is above the low pressure wellhead housing.

9. A system for injecting drill cuttings into a well, comprising:

a low pressure wellhead housing;

a high pressure wellhead housing supported in and protruding above the low pressure wellhead housing, the high pressure wellhead housing having a casing hanger connected to a string of casing and sealed to an inner diameter of the high pressure wellhead housing by a packoff, a flow passage having a lower end on an inner diameter of the wellhead housing beneath the packoff of the casing hanger, and an upper end on an outer diameter of the high pressure wellhead housing above the packoff;

a cuttings injector carried by the high pressure wellhead housing above an upper end of the low pressure wellhead housing and having a central passage that is in fluid communication with the flow passage; and wherein the drill cuttings are injected through the central passage and through the flow passage into an annulus surrounding the casing.

10. The system of claim 9 wherein the flow passage has an axially extending portion in a sidewall of the high pressure wellhead housing between the upper and lower ends.

11. The system of claim 9 wherein the well has guide posts, the system further comprising:

an injection ring that has an inner diameter that engages the outer diameter of the high pressure wellhead housing, the injection ring having an external port that is in fluid communication with the flow passage; and wherein the cuttings injector has an injection stab through which the central passage passes, the injection stab being hydraulically extendable into the external port to seal the central passage with the external port.

12. The system of claim 9 further comprising an injection ring having an inner surface that sealingly engages the outer diameter of the high pressure wellhead housing.

13. A system for injecting drill cuttings into a well, comprising:

a wellhead housing supported in the well and having a casing hanger connected to a string of casing and sealed therein by a packoff;

a flow passage having a lower end on an inner diameter of the wellhead housing beneath the packoff of the casing hanger, and an upper end on an outer diameter of the wellhead housing above the packoff;

an injection ring on the wellhead housing having an internal annular gallery and an external port, the gallery in communication with the upper end of the flow passage;

a cuttings injector landed on the injection ring and having a central passage sealed to the external port;

wherein the drill cuttings are injected through the central passage into the gallery of the injection ring and through the flow passage into an annulus surrounding the casing; and wherein the wellhead housing is supported by a low pressure wellhead housing and the injection ring is above the low pressure wellhead housing.

14. A system for injecting drill cuttings into a well, comprising:

a wellhead housing supported in the well and having a casing hanger connected to a string of casing and sealed therein by a packoff;

a flow passage having a lower end on an inner diameter of the wellhead housing beneath the packoff of the casing hanger, and an upper end on an outer diameter of the wellhead housing above the packoff;

an injection ring on the wellhead housing having an internal annular gallery and an external port, the gallery in communication with the upper end of the flow passage;

a cuttings injector landed on the injection ring and having a central passage sealed to the external port; and wherein the drill cuttings are injected through the central passage into the gallery of the injection ring and through the flow passage into an annulus surrounding the casing; and wherein the injection ring is mounted to rotate relative to the wellhead housing.

15. The system of claim 14 wherein the well has guide posts, the system further comprising:

a first guide frame joined to the injection ring adapted to engage the guide posts and position the injection ring; and a second guide frame joined to the cuttings injector adapted to engage the guide posts and position the central passage of the cuttings injector relative to the external port of the injection ring.

16. A method of injecting drill cuttings into a well comprising:

(a) providing a high pressure wellhead housing in the well having a sidewall with a flow passage extending therethrough and landing the high pressure wellhead housing in a low pressure wellhead housing with an inlet to the flow passage being above the low pressure wellhead housing;

(b) landing a cuttings injector on the well the cuttings injector having a central passage in fluid communication with the inlet of the flow passage; and (c) injecting the drill cuttings through the cuttings injector and flow passage into the well.

17. The method of claim 16 wherein step (a) further comprises the step of providing a casing hanger connected to a casing and sealed in the high pressure wellhead housing by a packoff, the inlet of the flow passage being above the packoff and an oulet for the flow passage being below the packoff, with a central portion of the flow passage extending downward through the sidewall, bypassing the packoff, and step (c) further comprises the step of injecting the drill cuttings into the well from the outlet of the flow passage beneath the packoff of the casing hanger and into an annulus surrounding the casing.

18. The method of claim 16 wherein step (b) further comprises extending an injection stab from the injector into engagement with the inlet of the flow passage.

* * * * *